United States Patent [19]

Winterbottom

[11] Patent Number: 4,510,357

[45] Date of Patent: Apr. 9, 1985

[54] ACTUATOR FOR TRANSFER CIRCUIT BREAKER SWITCH

[76] Inventor: Bruce Winterbottom, Egg Harbor, N.J.

[21] Appl. No.: 574,136

[22] Filed: Jan. 26, 1984

[51] Int. Cl.[3] ..... H01H 9/20

[52] U.S. Cl. ..... 200/50 R; 200/5 B; 200/50 C

[58] Field of Search ..... 200/50 C, 5 B, 18, 331, 200/DIG. 6, 50 R

[56] References Cited

U.S. PATENT DOCUMENTS 3,705,280 12/1972 Harms ..... 200/50 C 3,801,758 4/1974 Shand et al. ..... 200/50 C 4,383,146 5/1983 Bur ..... 200/50 C X

FOREIGN PATENT DOCUMENTS 613306 5/1935 Fed. Rep. of Germany .... 200/50 C

*Primary Examiner*—G. P. Tolin

*Assistant Examiner*—Susan Steward

*Attorney, Agent, or Firm*—Charles I. Brodsky

[57] ABSTRACT

An interconnect is described as coupling the arms of a pair of double-throw switches, to ensure that, although both switches can be in simultaneous "OFF" conditions, only one, or the other, can be in an "ON" condition at any given instant of time.

3 Claims, 9 Drawing Figures

FIG.1
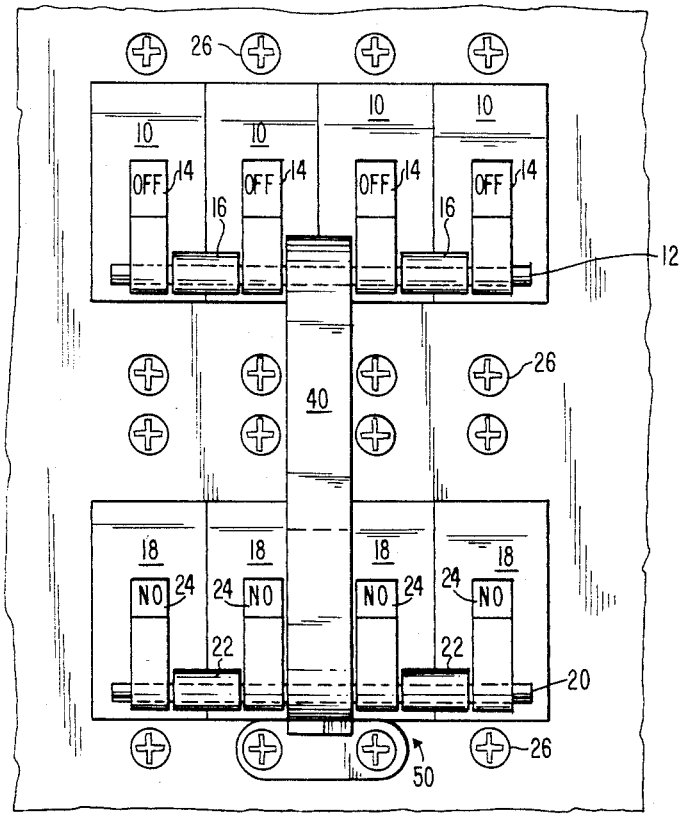
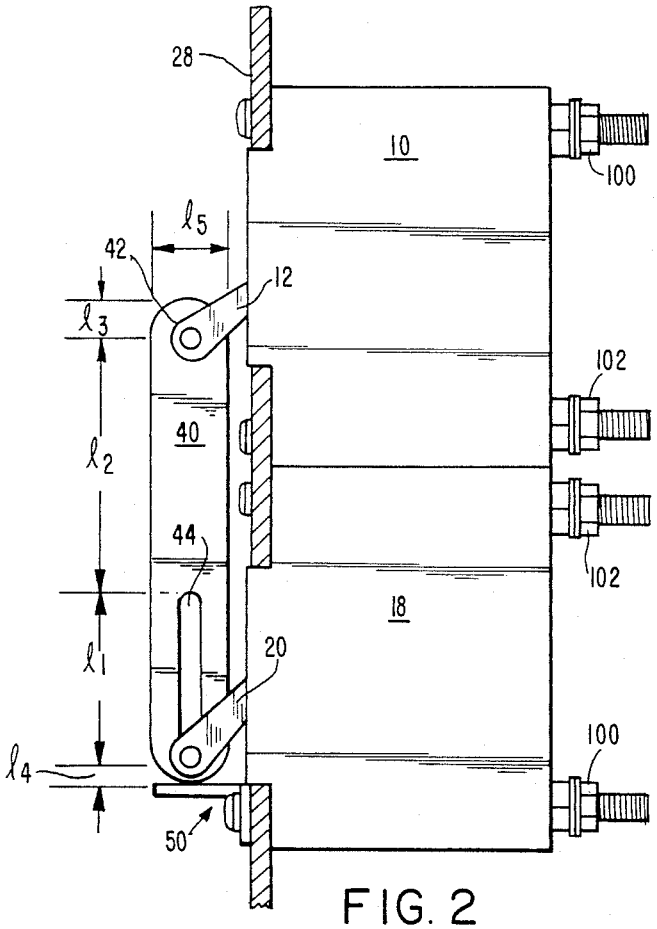
FIG. 2
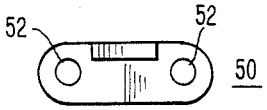
FIG. 3A
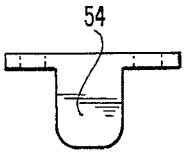
FIG. 3B
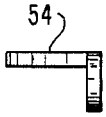
FIG. 3C

ACTUATOR FOR TRANSFER CIRCUIT BREAKER SWITCH

FIELD OF THE INVENTION

This invention relates to circuit breaker switches, in general, and to an actuator for controlling the circuit breaker switch to ensure that no more than one switch is in its "ON" condition at any given instant, in particular.

BACKGROUND OF THE INVENTION

As is well known and understood, many equipments aboard a power driven recreational boat can be energized from an on-board generator, or from shore power at dockside. As is also well known, the typical on-board arrangement utilizes a three-position switch to control the operation desired. In a first position, for example, the equipments are not connected to any energizing source (the "OFF" position), while in a second position (the "GENERATOR" position), the power producing apparatus aboard ship provides the necessary energization. In the third position of the switch (the "SHORE" position), the on-board equipments are energized from an appropriate source at the dock, or pier.

Usually in the form of a rotary switch, it will be appreciated by those skilled in the art that it is very important that neither the "GENERATOR" switch nor the "SHORE" switch will be "ON" together, if even for a slight period of time. As will be appreciated, if such were the case, an "electrolysis" type of condition could be created, which could create not only a possibility of damage for the equipment being powered, but could lead to other dangerous possibilities, as well.

SUMMARY OF THE INVENTION

As will become clear hereinafter, a preferred embodiment of the present invention arranges two switches, one above the other, in the manner they would appear as in a conventional circuit breaker hook-up. The actuator arms of these switches—which are understood to be disassociated one from another and actuable independently of one another in usual circuit breaker configurations—are, according to the invention, interconnected by a coupling link to ensure that although both can be controlled to a simultaneous "OFF" condition, only one, or the other, can be controlled to an "ON" condition at any given time. As will be seen from the following description, the inter-coupling link is apertured at one end, to hold in close-fit, the actuator of the upper circuit breaker switch in the vertical alignment. As will also be seen, the inter-coupling link is slotted at an opposite end, to receive the actuator arm of the lower circuit breaker switch, which is free to move within. By arranging the dimensions of the inter-coupling link with the physical sizes of the circuit breaker switches, and the extent of rotation of their actuator arms in moving from "open" or "closed" positions, the inter-coupling link is effective to control a previously "ON" switch to a definite "OFF" condition before the other switch can be coctrolled "ON"; this ensures that the two switches will not be in an "ON" condition simultaneously.

BRIEF DESCRIPTION OF THE DRAWINGS

These and other features of the present invention will be more clearly understood from a consideration of the following description, taken in connection with the accompanying drawings in which:

FIG. 1 illustrates a preferred embodiment of the actuator of the invention for a circuit breaker in which the upper-most switch is in an "OFF" condition and the lower-most switch is in an "ON condition;

FIG. 2 is a side-sectional view of the actuator of FIG. 1, taken along the line A—A;

FIGS. 3A–3C respectively illustrate front, top, and right-side views of a "stop" for the inter-coupling link of the actuator;

DETAILED DESCRIPTION OF THE DRAWINGS

Figure 4:
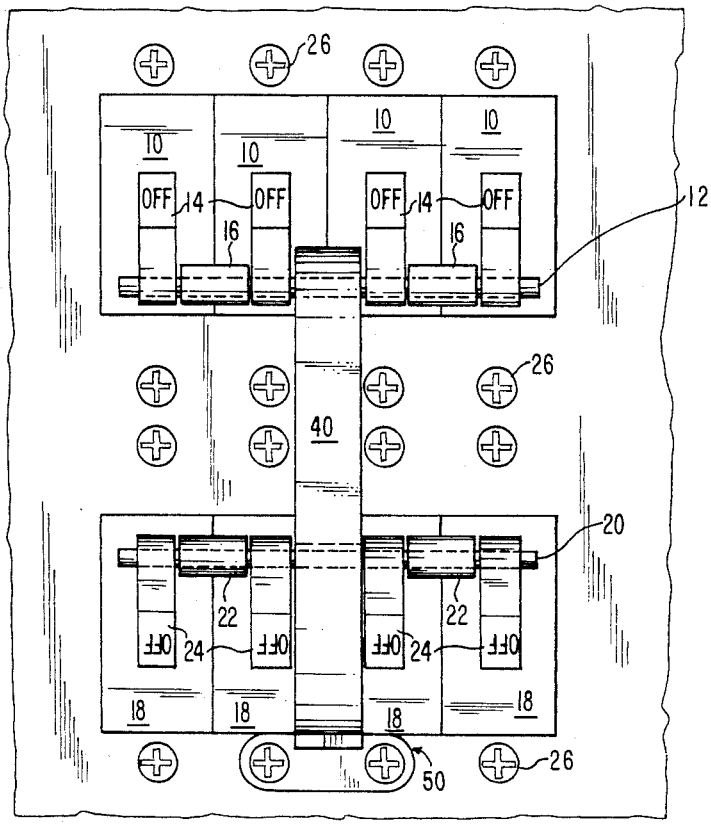
FIGS. 4–5 show illustrations corresponding to those of FIGS. 1 and 2, but for the instance where both switches are in their "OFF" mode.

Referring to FIGS. 1–2 and 4–7, the upper-most circuit breaker switches are shown by the reference numeral 10, which are "ganged" together by means of a rod 12 passing through apertures in the individual switch controls 14 and through finger-grips 16 for grasping. The lower-most switches are illustrated by the reference numeral 18 with a similar aperture-passing rod 20 and finger grips 22 for the individual switch controls 24. When mounted by means of a plurality of screws, or similar means 26 on a circuit breaker panel board 28, the individual switches 10, 18 are effective in either "making" or "breaking" connections between their respective terminals 100, 102.

Figure 5:
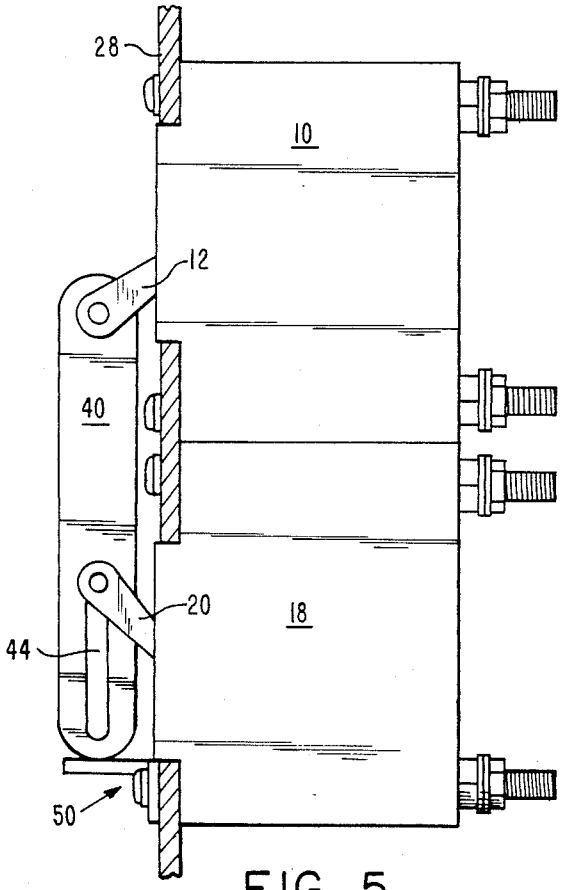
Figure 7:
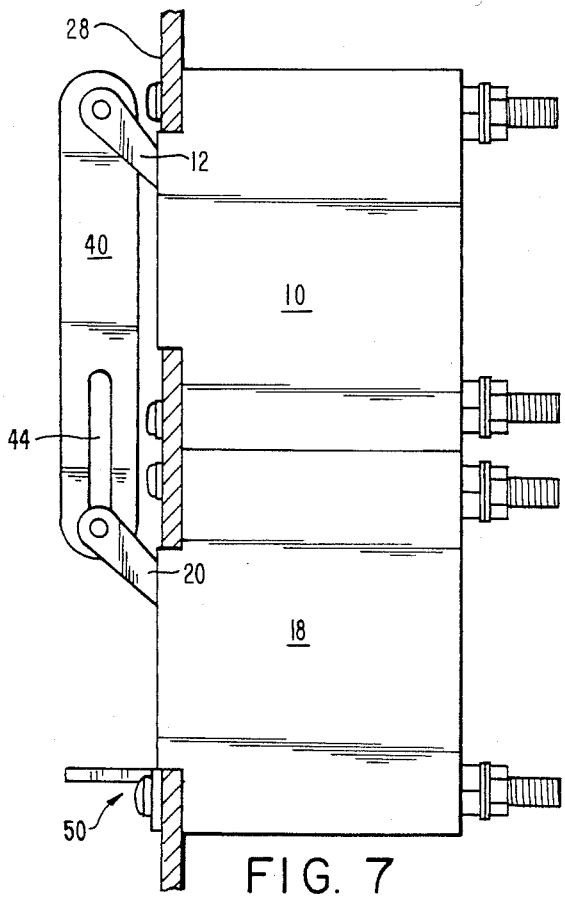

In accordance with the invention, the "ganged" rods 12, 20 are coupled together by means of an interconnecting link 40. As is more clearly shown in FIGS. 2, 5 and 7, the link 40 is apertured at 42, adjacent at its upper end, and by an amount to receive the "ganged" rod 12 in close-fit. As is also shown in FIGS. 2, 5 and 7, the link 40 is apertured at 44, towards the lower end of the link 40, in a "slot-arrangement" in which the "ganged" rod 20 is arranged to slide. The length of the slot 44 (i.e. $l_1$) is selected, according to the invention, so as to cooperate with the individual switch controls 14, 24, so that the top and bottom limits of the slot 44 contact the "ganged" rod 20 when the lower-most switch 18 is in its "OFF" and "ON" conditions, respectively.

With the arrangement illustrated in FIGS. 1 and 2, the upper-most switch 10 will be seen to be in its "OFF" condition, and the lower-most switch 18 will be seen to be in its "ON" condition. This can represent, for example, one situation in the power-boat switching scheme between "on-board" powering and "dockside" powering, where the marine equipments are being energized from the ship's own generator.

FIGS. 4 and 5, on the other hand, represent the situation where both switches 10 and 18 are each controlled to an "OFF" state. According to the invention, such could be accomplished merely by lifting up on the finger-grips 22, thereby rotating the "ganged" arm 20 upwardly within the slot 44 of the link 40, until the individual switches 24 are brought to their "OFF" mode. Because of the length $l_1$ selected for the slot 44 (see FIGS. 2, 5 and 7), the rotation of arm 20 has no effect on the positioning of the "ganged" arm 12, and the upper-most switch 10, for such reason, remains in the orientation shown in FIG. 1. With such positioning, therefore, both sets of switches 10, 18 are in their "OFF" conditions, and, in the marine equipments context being considered, no energization is being provided from any electrical source.

Figure 6:
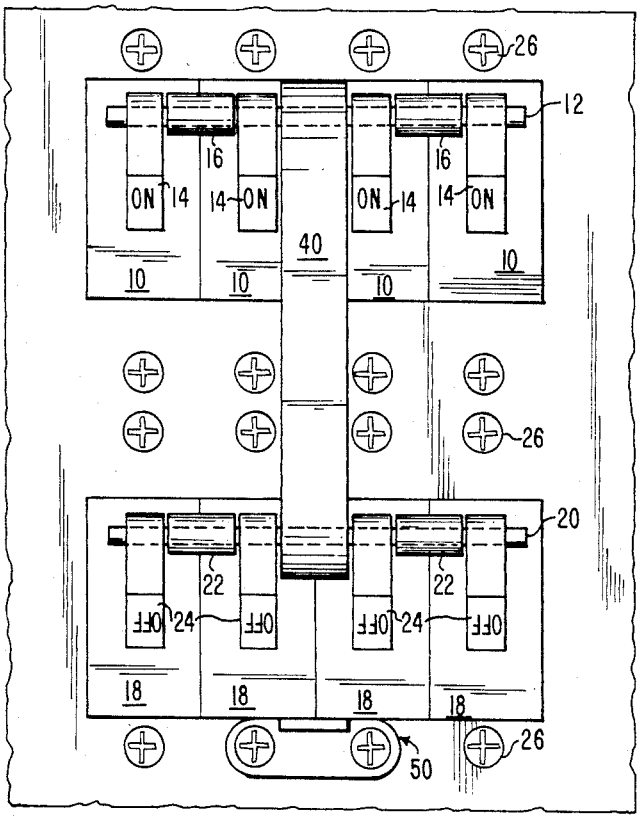
FIGS. 6–7 are illustrations corresponding to those of FIGS. 1 and 2, but where the upper-most switch of the circuit breaker is "ON", and where the lower-most switch is "OFF".

Proceeding, now, to FIGS. 6 and 7, where it is intended to control the circuit breaker switches from the "all OFF" posture of FIGS. 4–5 to the condition where the upper-most switch 10 is "ON" and the lower-most switch 18 is "OFF", such will be understood to occur by an upwards grasping of the fingerholds 16 which result in the inter-coupling link 40 being moved upwardly (FIG. 7, as compared to FIG. 5), which has the corresponding effect of, in essence, causing the "ganged" arm 20 to slide downwardly within the slot 44. As there is no constraint on the "ganged" arm 20 until the upper-most switch 10 has already reached its desired state, such upward movement of the "ganged" arm 12 has no effect in causing the "ganged" arm 20 to alter the state of the switch 18. With such position, the condition can be said to be reached in which the switches, for example, are connecting "dockside" power to the electrical equipment aboard the ship's vessel.

As so far described, therefore, the actuator of the invention is effective in having the lower-most switch 18 "ON" and the upper-most switch 10 "OFF"; or both switches 18 and 10 "OFF"; or the lower-most switch 18 "OFF" and the upper-most switch 10 "ON". However, in accordance with an object of the invention, it is of utmost importance that neither switch 18 nor switch 10 be both "ON" at the same time. With the slotted-actuator link 40 of the invention, though, this is prevented from taking place. Referring to FIGS. 1 and 2, for example, any tendency to move the upper-most switch 10 "ON" by the lifting of the finger-grips 16 will result in the "ganged" arm 12 pulling-up on the coupling link 40—the lower end of whose slot 44 would then exert a force upwardly on the "ganged" arm 20 of the lower-most switch 18, and with the respective dimensionings of the slot 44 being selected in accordance with the rotational needs of the slotted arm 12 to change the position of the individual switches 14 being so selected that the "ganged" arm 20 is effective in controlling the lower-most switch 18 to an "OFF" condition prior to the "ganged" arm 12 being sufficiently upwardly rotated to turn the upper-most switches 14 "ON". Thus, any attempt to control the upper switch 10 "ON", when started from its FIG. 1 and FIG. 2 position, is, of necessity, preceded by the automatic controlling of the lower-most switch 18 "OFF". As will be seen, therefore, the coupling link 40 thus operates to restrain the upward action on the "ganged" arm 12 from placing both switches 10, 18 in an "ON" condition at any given instant of time.

Similar results can be observed when using the arrangements of FIGS. 6–7 as the starting reference. As previously noted, such illustrations depict the condition of the circuit breaker switches for the mode where the upper-most switch 10 is "ON" and the lower-most switch 18 is "OFF". There, any tendency to move the lower-most switch 18 "ON" by the downward pulling of the finger-grips 22 will result in the "ganged" arm 20 pulling-down on the coupling-link 40 against which it is in physical contact at the time—producing a similar, downwardly directed translational force on the "ganged" arm 12 of the uppermost switch 18, which is in close-fit with the link 40 by means of the aperture 42. Again, respective dimensionings of the coupling link 40, and of the slot 44 are so selected that the rotation imparted to the "ganged" arm 12 of the upper-most switch 10 is effective in controlling the upper-most switch 10 "OFF" prior to the lower-most switch 18 being controlled "ON" by the downward pulling of the finger-grips 22. With such arrangement, it will then equally be observed that the coupling link 40 is effective in producing a transistion-over of one of the switches 10, 18 to an "OFF" condition in initial response to any attempt to regulate both switches to their "ON" states, simultaneously.

While applicant does not wish to be limited to any particular use of dimensions, the following have proved particularly attractive in carrying out the preferred embodiment of the invention herein described:

| | |
|---|---|
| $l_1$ | 1⅛ inches |
| $l_2$ | 1 11/16 inches |
| $l_3$ | ¼ inch |
| $l_4$ | ⅛ inch |
| $l_5$ | ½ inch |

As illustrated in the drawings—and particularly in the views of FIGS. 3A–3C—the circuit breaker construction of the invention is also provided with a "stop" 50 to regulate the downward motion of the coupling link 40. As illustrated, the "stop" 50 is provided with fastener apertures 52 and with an extending lip 54. As will be understood from the foregoing description, the location of the "stop" 50 along the panel 28 is of particular significance in providing the "snap" which gives rise to the automatic switching "OFF" of a previously "ON" switch, at a time when a manual attempt is made to control the other switch "ON" at the same time. Thus, and as indicated quite clearly in FIG. 2, the location of the "stop" 50 provides an "offset" to the "ganged" arm 20 already in a direction as to control such switch "OFF". By having the dimension $l_4$ less than the dimension $l_3$ (as set-forth above), the lower-most switch is already "biased" in an "OFF" direction even while the lower-most switch is "ON"; with this degree of "offset", the "ganged" arm 20 thus requires less movement to reach its "OFF" controlled condition than is required by the "ganged" arm 12 in reaching its controlled "ON" state. Thus, the lower-most switches 18 will be controlled "OFF", for example, before any upward-lifting of the finger-grips 16 is effective to control the upper-most switches 10 "ON".

While there has been described what is considered to be a preferred embodiment of the present invention, it will be readily apparent to those skilled in the art that modifications can be made without departing from the scope of the teachings herein. For example, although the invention has been illustrated in the context of having four individual sections in each of the upper-most and lower-most switch arrangements, it will be appreciated that any numbers of individual switches can be utilized, and the operational description would continue without modification. It will also be seen, furthermore, that additional banks of circuit-breaker switches can be added to the vertical alignment, and that by replicating the coupling link 40 with additional slots constructed similarly to that identified by reference numeral 44, the control actions described above can be imparted to such additional configurations, so as to prevent more than one switch from being controlled "ON" at any interval of switching. For at least such reasons, therefore, resort should be had to the claims appended hereto for a correct understanding of the scope of the invention.

I claim:

1. In a circuit breaker configuration of the type in which individual switch components are aligned adjacent one another and whose condition of operation is determined by the respective positionings of the control arms thereof, in which a first plurality of such switch components are interconnected together for a simultaneous tandem operation of a first type, in which a second plurality of such switch components are interconnected together for a simultaneous tandem operation of a second, different type, and in which said first and second pluralities of switch components include first and second control arms oriented so that said arms are positioned away from each other when said switch components are on and towards each other when said switch components are off, apparatus comprising:

rod means, coupled between the control arms of adjacent switch components in each of said first and second switch component pluralities, and linking said arms of each plurality together;

an interlock;

with a first end of said interlock being apertured to receive said rod means of one of said switch component pluralities, and to transfer to said rod means substantially any lineal movement imparted to said interlock;

with an opposite end of said interlock being slotted to receive said rod means of the other of said switch component pluralities, in affording a degree of lineal movement therein;

with the length of said slot being slightly less than the lineal distance between the positionings of said first and second control arms when in "ON" and "OFF" conditions, respectively;

and with one end of said slot being co-linear with the position of the switch control arm when in either of its states of on-off operation.

2. The apparatus of claim 1 wherein the aperture of said interlock receiving the control arm of said one switch component plurality is situated further from said first end of said interlock than is the near end of said slot receiving the control arm of said other switch component plurality from said opposite end of said interlock.

3. The apparatus of claim 2 wherein the placement connection of said interlock between said switch control arms is selected such that the lineal distance traversed by the control arm of said one switch component plurality in transitioning between its said "ON" and "OFF" conditions is slightly greater than the lineal distance traversed by the control arm of said other switch component plurality in transitioning between its same two conditions of operation.

* * * * *